US005464124A

United States Patent [19]

Weyh et al.

[11] Patent Number: 5,464,124

[45] Date of Patent: Nov. 7, 1995

[54] APPARATUS FOR PREPARING AND DISPENSING POST-MIX BEVERAGES

[75] Inventors: Werner Weyh, Knittlingen; Udo Schwander, Karlsruhe; Raimond Gatter, Bretten; Robert Notar, Knittlingen; Helmut Konopa, Leipheim; Klaus Erdmann, Bretten, all of Germany

[73] Assignees: The Coca-Cola Company, Atlanta, Ga.; Bosch-Siemens Hausgerate GmbH, Munich, Germany

[21] Appl. No.: 233,973

[22] Filed: Apr. 28, 1994

[30] Foreign Application Priority Data

Aug. 28, 1992 [DE] Germany ..... 42 28 770.7

[51] Int. Cl.[6] ..... B67D 1/00

[52] U.S. Cl. ..... 222/129.1; 222/144.5; 222/146.6; 261/DIG. 7

[58] Field of Search ..... 222/129.1, 129.3, 222/129.4, 23, 54, 144.5, 146.6, 129.2, 132, 72; 62/59, 398, 399, 400; 261/DIG. 7; 141/104, 105

[56] References Cited

U.S. PATENT DOCUMENTS

| | | | |
|---|---|---|---|
| 2,391,003 | 12/1945 | Bowman | 141/104 |
| 2,462,019 | 2/1949 | Bowman | 222/129.4 |
| 2,586,499 | 2/1952 | Anderson | 261/11 |
| 4,211,342 | 7/1980 | Jamgochian et al. | 222/129.4 |
| 4,632,275 | 12/1986 | Parks | 222/25 |
| 4,687,120 | 8/1987 | McMillin | 222/1 |
| 4,764,315 | 8/1988 | Brusa | 261/140.1 |
| 5,002,201 | 3/1991 | Hancock et al. | 222/61 |
| 5,310,088 | 5/1994 | Burrows | 222/67 |

FOREIGN PATENT DOCUMENTS

| | | |
|---|---|---|
| 296570 | 12/1988 | European Pat. Off. . |
| 320262 | 6/1989 | European Pat. Off. . |
| 471343A | 2/1992 | European Pat. Off. . |

*Primary Examiner*—Andres Kashnikow
*Assistant Examiner*—Lisa Douglas

[57] ABSTRACT

Carbonator apparatus used in connection with a postmix beverage dispenser system includes a water delivery branching circuit for the water fed under pressure from a fresh water source and which is used to fill a storage tank for carbonated water produced therein and to supply fresh water to a recirculating type of fresh water cooling structure which includes a water circulating coil located in the bottom of the storage tank and/or a water channel guide located on the outside of the storage tank. The branching system selectively enables fresh water to be fed into a carbonator storage tank where the water is blended with $CO_2$ gas or is guided around it while being cooled without being carbonated so that either cooled carbonated water or non-carbonated water is delivered to a mixing station along with a drink concentrate.

15 Claims, 2 Drawing Sheets

1
2
3
4
5
6
7
8
9
10
11
12
13
14
15
16
17
18
19
20
21
22
23
24
25

5
13
14
15
16
17
18
19
23'
29
30

APPARATUS FOR PREPARING AND DISPENSING POST-MIX BEVERAGES

This is a continuation of International Application PCT/EP93/02281, with an international filing date of Aug. 25, 1993.

BACKGROUND OF THE INVENTION

This invention relates to apparatus for preparing and dispensing beverages wherein one of a plurality of drink concentrates and cooled water are brought together in a predetermined ratio for preparing a particular beverage, and where the water comprises either fresh water or carbonated water.

Apparatus for mixing fresh water with $CO_2$ gas to produce carbonated water is well known and is used, for example, in post-mix beverage dispensing machines so that carbonated beverages can be prepared and dispensed on demand by mixing carbonated water with a suitable drink concentrate. The carbonated water mixed with the drink concentrate is produced directly in the storage tank by mixing fresh water with $CO_2$ gas which is fed thereto and thereafter cooled for better carbonation, this being a requirement for a cool refreshing drink which is prepared for consumption as the need arises. The storage tank, commonly referred to as a carbonator, is fed fresh water of drinking quality either from the line of a water supply system or a pressurized storage tank. The fresh water, moreover, can be fed from the water supply system under pressure and can be enhanced, when desired, by the use of a pressure pump. Further, $CO_2$ gas is fed to the carbonator from a $CO_2$ gas storage tank by a pressure-reducing regulating valve so that a pressure of, for example, about 4 bars is built up in the carbonator.

In order to ensure sufficient carbonation of the fresh water, the carbonation process is accomplished by or assisted by the use of a $CO_2$ circulating pump located in the carbonator. This type of pump draws $CO_2$ gas from the upper or head-space region of the carbonator filled with $CO_2$ gas and blends it with circulating water which is set in circular motion, such as by spinning.

As already noted, cooling of the carbonator is used, not only to improve the carbonation, but also as a requirement so that the finally prepared and dispensed drink exhibits a desired low and basically constant temperature. The cooling in the carbonator is achieved by a cooling system, which is adapted to form an ice bank of generally uniform thickness along the inner side walls of the carbonator as a result of the circulating water. Consequently, a cooling capacitor is produced, thus enhancing its "refrigerating capacity", thereby removing the need for a relatively powerful cooling system which would be necessary in a once-through cooling system.

When a freshly prepared beverage of a certain type is desired, a valve is opened in an output line connected to the bottom area of the carbonator, whereupon cooled carbonated water, metered by a flow-volume regulating valve, is fed to a mixing station to which a correspondingly metered amount of a selected drink concentrate is also fed. To provide a possibility of selection among several concentrates, the carbonated water can be individually fed to a dispensing point of the individual concentrate or conveyed past all dispensing points in succession for example, by a mixing station. The bringing-together of different concentrates at one and the same mixing point is somewhat more complicated.

It is also now desirable to be able to prepare and dispense beverages without $CO_2$ content in addition to beverages with $CO_2$ content. So that beverages made with fresh water are both refreshing and tasty, it becomes desirable that the fresh water is also delivered at a suitable temperature.

SUMMARY

The object of this invention is to provide an improvement in apparatus for preparing and dispensing both carbonated drinks and fresh water drinks while saving as much space and expense as possible in its design without sacrificing quality.

Apparatus which fits these requirements comprises a dispenser which includes a branching system, for the water fed under pressure to fill the storage tank, placed downstream in the supply line. The branching system selectively enables fresh water to be fed into a carbonator storage tank where the water is blended with $CO_2$ gas or is guided by a bypass line through the storage tank and/or around it without being carbonated, where it is then supplied to a location near the mixing area where the drink concentrate is located. When desirable, another storage tank can be used to store cooled fresh water and is like the carbonator except that no $CO_2$ gas is fed to it. To meet these requirements, a similar cooling system and a similar circulating pump are at least desirable and in some instances, necessary.

In this way, a device for preparing and dispensing refreshing drinks, a so-called drink dispenser for postmixed drinks, has its utility broadened so that with a single compact type of construction and without a special storing of suspending liquids, the possibility remains, as in the past, to dispense carbonated beverages, but now the possibility is opened up to prepare non-carbonated beverages as well.

If a carbonated beverage is desired, the dispensing of suitably cooled carbonated water takes place directly from the carbonator. By cooling the carbonator in a well known way, a sufficient amount of drink portions is guaranteed having a desired cooled temperature. If a non-carbonated drink is desired, the bypass line for the fresh water is passed through the carbonator storage tank and/or around an outside thermally cooled conducting water channel. Both the temperature prevailing in the tank and the "refrigerating capacity" are used with full effectiveness, so that additional individual cooling elements or regulating devices are not required.

To assure the correct mixing ratio with the allocated concentrate even in the case of $CO_2$-free beverages, the water fed by the bypass line to the dispensing point passes through flow-volume regulator similar to that with respect to the carbonated water. In principle, it could be left to the discretion of the user whether carbonated water or non-carbonated water is to be added to a specified drink concentrate. However, since most drink concentrates are suitable for mixing with but one of these two water types, the system will preferably be equipped so that with the selection of a specific beverage, a correct mixing ratio of a corresponding drink concentrate selected from a large number of available drink concentrates will be automatically provided.

According to one preferred embodiment of the invention, the bypass line passing through the storage tank is located in a lower section of the storage tank around a circulating pump. It is also desirable to locate the above mentioned outside thermally conductive water channel adjacent the lower section of the storage tank by being thermally bonded to its wall. Because of the special behavior of water and also of carbonated water, the bypass line is provided in areas of the storage tank where the water is somewhat above the freezing point. In order to completely rule out malfunctions of this apparatus by ice deposits, the bypass line and the water channel can be suitably equipped with an icing sensor and with a heater controllable by the latter. Icing inside the bypass line is also effectively prevented by locating the evaporator lines being used for cooling and forming an ice bank inside the wall of the storage tank in the upper area of the storage tank away from the location of the bypass line.

According to another preferred embodiment of the invention, a pump system for circulating the contents of the bypass line is placed between the ends of the bypass line passed through the storage tank and the outside thermally conducting well. The possibly existing danger of icing inside the bypass line can be prevented in such an arrangement. Further, the contents of the bypass line lying outside the actual cooling zone inside the tank is also kept in a constant cooling state by enlarging and thermally insulating the region of the bypass line lying outside the tank. The circulation can be made dependent on the temperature in the bypass line, the use of a temperature sensor which directly or indirectly controls a circulating pump coupled into the system.

In this enlarged section of the bypass line, the danger exists that air, which was originally dissolved in water, settles and fills this space. To prevent this, an air separator can also be placed in the enlarged section. It is also desirable to use an air separator in the branching system forward of the bypass for the water fed into the line of the carbonator. The air not collected in the carbonator is mixed in the water together with the fed $CO_2$ gas and removed with the latter. With respect to design, it is especially desirable to equip the branching system with a reversing valve. It is also possible to include a respective shutoff valve from branching system to the carbonator and in the bypass line. These two valves are opened alternately as required and simultaneously, in the case of the necessary and usually used feed pump, when the latter is put into operation. It may also be possible in certain special cases to dispense simultaneously and to mix carbonated water and non-carbonated water with one another.

BRIEF DESCRIPTION OF THE DRAWINGS

The details of the invention as set forth below will be more readily understood when considered together with the following drawings, wherein.

DETAILED DESCRIPTION OF THE INVENTION

Figure 1:
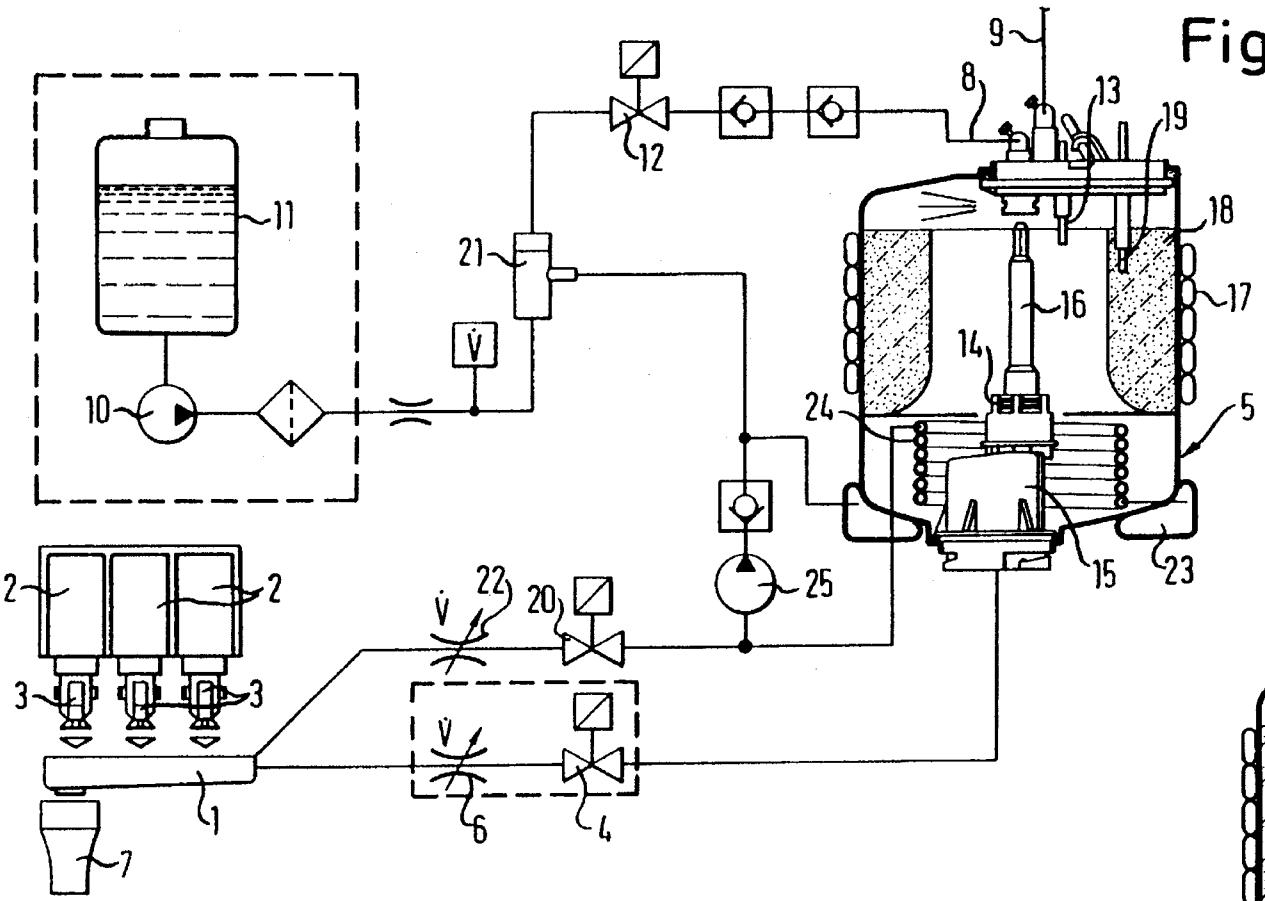
FIG. 1 is a mechanical schematic diagram illustrative of a preferred embodiment of the subject invention for selectively dispensing both carbonated and non-carbonated beverages.
Figure 2:
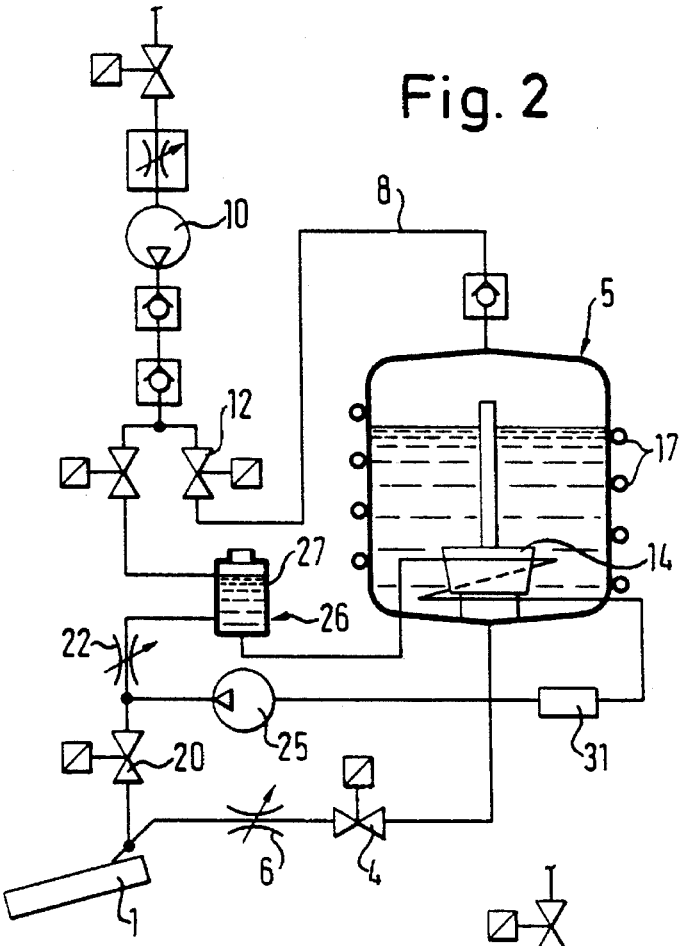
FIG. 2 is a mechanical schematic diagram of a variation of the drink dispensing system shown in FIG. 1.
Figure 3:
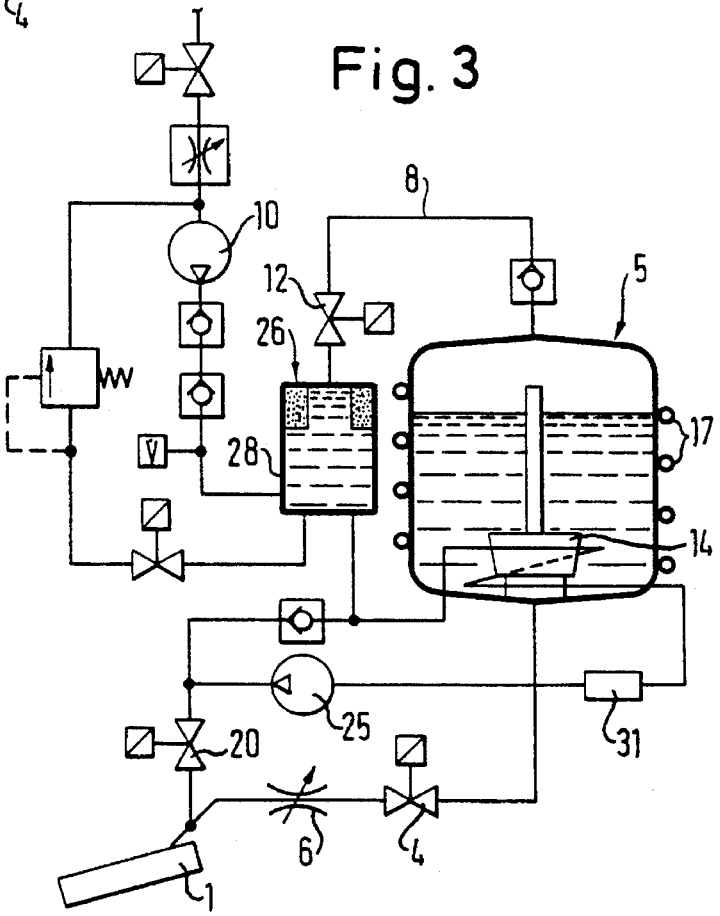
FIG. 3 is a mechanical schematic diagram of a modification of the system shown in FIG. 2.

Referring now to the drawings, FIGS. 1, 2 and 3 each disclose arrangements in which a post-mix beverage is made and dispensed in the vicinity of a mixing station 1 by mixing a selected drink concentrate with cooled, non-carbonated or carbonated water.

As FIG. 1 shows, three concentrate containers 2, each with an allocated valve type dispensing system 3, are located above the mixing station 1. As soon as one of these three valve systems 3 is actuated by a controller, not shown, the actuated valve system 3 conveys a suitable drink concentrate from allocated storage container 2 to the mixing station 1.

If a $CO_2$-containing, i.e. carbonated beverage is to be prepared, a shutoff valve 4 is opened at the same time or spread over time, so that carbonated water from a storage tank 5, which is processed and cooled therein, is delivered under pressure from the valve 4 by a flow-volume regulator 6 to the mixing station 1. In the mixing station 1, the dispensed drink concentrate and carbonated water meet and jointly flow into a glass or a breaker 7, where they mix and are removed as a refreshing beverage ready for consumption.

Storage tank 5 is commonly referred to as a carbonator. Water is fed into the tank 5 by a supply line 8 and $CO_2$ gas is supplied by a supply line 9, each under pressure. The water pressure is produced by a pressure feed pump 10, which draws fresh water from a water storage tank 11, when required, and feeds it through an opened shutoff valve 12 into storage tank 5. The required water level within storage tank 5 is detected by a water level sensor 13 which controls the actuation of the pressure feed pump 10 and shutoff valve 12.

The $CO_2$ gas supply is automatically regulated by a pressure-reducing/pressure-regulating valve, not shown, upstream of the supply line 9, so that, for example, a pressure of 4 bars is built up in storage tank 5. This pressure is also used for the purpose of delivering the carbonated water for mixing station 1 from the storage tank 5 by the shutoff valve 4, when opened, and by the flow volume regulator 6.

In the headspace of the storage tank 5, a cushion of $CO_2$ gas is formed above the water stored therein. $CO_2$ gas is drawn down by a circulating pump 14 located in the tank 5 and mixed with the stored water in the vicinity of the pump 14. The circulating pump is driven by an electric motor 15. In this way, the water is circulated, and rotated inside the storage tank around the vertical axis of a $CO_2$ suction pipe 16.

The stored, carbonated water within storage tank 5 is cooled by a set of cooling coils 17 of a cooling system, not shown. The coils are secured to the exterior of the side wall of the storage tank 5. In this way, an ice bank 18 is formed inside the storage tank on the side wall adjacent the cooling coils 17. The thickness of the ice bank 18 is detected by an ice sensor 19 which controls the actuation of the cooling system.

The carbonated water within storage tank 5 is thus cooled to a temperature near the freezing point. Because of the special physical characteristic of the water as a function of temperature, the somewhat warmer zones lie in the bottom portion of the storage tank 5 near the dispensing opening, which passes through the housing of electric motor 15. A danger of icing in this area normally does not exist.

The ice bank 18 also represents the refrigerating capacity for storage tank 5, so that for a short time a number of beverages can be dispensed that are sufficiently cooled, without the cooling system having to be set into operation.

If now a $CO_2$-free beverage is to be dispensed instead of one which is carbonated, a particular valve system 3 for adding a drink concentrate is actuated as before. But now the shutoff valve 4 remains closed, and instead, shutoff valve 20 is opened. Since the water pressure of storage tank 5 is lacking, hydraulic feed pump 10 must be actuated simultaneously with the opening of shutoff valve 20. Since shutoff valve 12 is also closed, fresh water from the storage tank 11 is diverted at a branch point 21 and conveyed by an opened shutoff valve 20 and a flow-volume regulator 22 to the mixing station 1, where it meets and mixes the selected drink concentrate before it reaches the drink cup 7. From branch point 21 to shutoff valve 20, however, the fresh water is first made to pass through a water guide channel 23 which is thermally coupled to and located in the lower part of the storage tank 5. The guide channel 23 is coupled to a pipeline 24 which runs spirally inside of the storage tank 5 so that it coils around circulating pump 14.

This structure sufficiently cools the non-carbonated water necessary for the preparation of a post-mix beverage without a separate cooling system having to be provided. Also, the refrigerating capacity of the ice bank 18 is used with portion of the apparatus.

By the arrangement of water guide channels 23 and pipeline 24 in the basically ice-free zone of the storage tank 5, the danger of an icing in the latter is further reduced. However, this danger can be overcome by still other schemes. For example, the inclusion of a feed pump 25, which is connected in parallel with the flow of water in the cooling members 23 and 24, as shown in FIG. 1 permits recycling of the cooled fresh water from the top of the cooling coil 24 back to the input of the channel member 23. The cooled water can be circulated either constantly, intermittently, or controlled by a thermal sensor, not shown, located in the water. Such an arrangement of the feed pump 25 also opens up the possibility as shown in FIGS. 2 and 3, of including a small supplementary external fresh water storage tank 26.

Referring now to the embodiments shown in FIGS. 2 and 3, in these configurations the cooling of the non-carbonated fresh water passing through the storage tank 5 only takes place in the coils 24. Both of these representations also illustrate means for releasing air trapped in the non-carbonated water circuit, so that no inclusion of air within the system impairs its efficiency.

Air separation according to FIG. 2 takes place by an air separator 27 located in the flow of water for the non-carbonated water in the auxiliary tank 26 so that air separated thereby can exit into the ambient atmosphere. Correspondingly acting exhaust valves, which close in the case of liquid wetting and open in the case of drying, are known. This air separator 27 can be designed for a correspondingly enlarged cooling-water tank when desired.

The air separator 28 shown in FIG. 3 is located at the branch point where the fresh water is fed to the carbonator 5 and where the recirculating fresh water is fed to its cooling coil and then to the dispensing point in the mixing station 1 via the elements 31, 25 and 20. Element 31 comprises an enlarged feed line segment for increasing the circulating volume. In the air separator 28, the air dissolved in the water and escaping from it is collected in the upper area and transported from there with the water when shutoff valve 12 in storage tank 5 is opened. Together with the $CO_2$ gas present there, this air in the headspace does not present any problems. On the other hand, at the bottom portion of the air separator 28, the water not being carbonated is fed to the fresh water cooling coil. To increase the volume of the recirculated fresh water, the line coupled to the feed pump 25 is provided with an enlargement 31.

Figure 4:
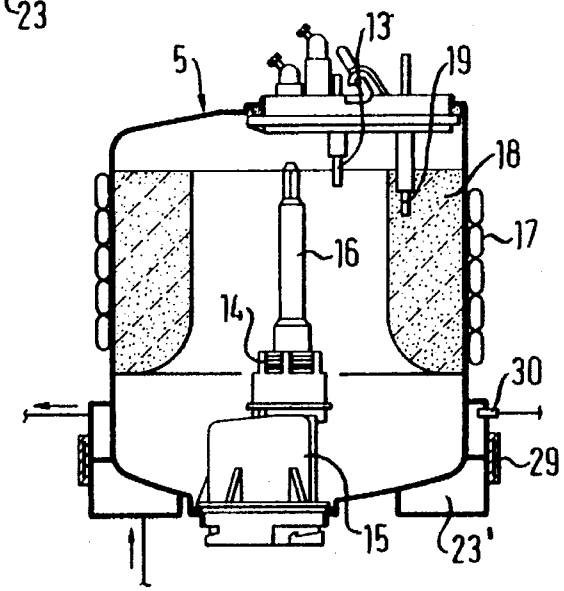
FIG. 4 is a cross-sectional view of a storage tank for carbonating water and including an external bypass configuration.

FIG. 4 is illustrative of a storage tank 5 having a thermally coupled water guide channel 23' attached to the lower outside portion of the storage tank 5. However, in this embodiment, the water guide channel 23' is comprised of two turns or channel segments running around the storage tank 5 with the upper segment having a temperature sensor 30 inserted therein for measuring the temperature of the non-carbonated water. Also a heating element 29, e.g. a foil heating element, is secured to the outside of the water guide channel 23 between the two channel segments to assist in any de-icing if necessary.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus for preparing and dispensing postmix beverages, comprising:

a storage tank for holding water used in preparing postmix beverages and including first water cooling means located at an upper part of the tank and second water cooling means located at a lower part of the tank;

means for supplying fresh water under pressure to the storage tank;

means for introducing $CO_2$ into the storage tank;

branch circuit means coupled to said supplying means and including first water delivery means for selectively delivering fresh water to the storage tank for mixing with $CO_2$ therein to produce carbonated water and second water delivery means for delivering fresh water to said second water cooling means, said second cooling means being thermally coupled to the cooled storage tank for separately cooling only fresh water delivered from said water supply means;

third water delivery means for delivering a predetermined volume of said carbonated water from the storage tank to a mixing station when a carbonated beverage is desired;

fourth water delivery means coupled to said second water cooling means for delivering a predetermined volume of cooled fresh water to said mixing station when a non-carbonated beverage is desired;

concentrate container means for holding and conveying a predetermined amount of at least one drink concentrate to said mixing station when a carbonated or a non-carbonated beverage is desired; and fresh water recirculating means coupled between said second water delivery means and said fourth water delivery means for recirculating fresh water around said second water cooling means prior to delivery to said mixing station by way of said fourth water delivery means.

2. The apparatus according to claim 1 wherein said second cooling means includes a fresh water cooling coil.

3. The apparatus according to claim 1 wherein said second cooling means includes a fresh water cooling coil located inside the storage tank.

4. The apparatus according to claim 1 wherein said second cooling means includes a water guide channel located on the outside of the storage tank.

5. The apparatus according to claim 1 wherein said second cooling means includes a cooling coil located in a lower portion of said storage tank and a water channel guide coupled thereto located on the outside of said storage tank adjacent the cooling coil.

6. The apparatus according to claim 1 wherein said fresh water recirculating means includes a circulating pump.

7. The apparatus as according to claim 6 and additionally including temperature sensor means thermally coupled to said second cooling means and being responsive to the temperature of the fresh water being recirculated for controlling the operation of the circulator pump.

8. The apparatus according to claim 6 and wherein said fresh water recirculating means includes one-way check valve means connected in series with the circulating pump for providing unidirectional fresh water flow through said second water cooling means.

9. The apparatus according to claim 8 and wherein said third and fourth water delivery means each include flow control valves for selectively delivering carbonated water and non-carbonated water to said mixing station.

10. The apparatus according to claim 6 wherein said fresh water recirculating means includes an enlarged flow path for increasing the circulating volume of the fresh water being recirculated.

11. The apparatus according to claim 6 wherein said second water delivery means includes air separator means.

12. The apparatus according to claim 6 wherein said second water delivery means includes a supplementary water tank for fresh water.

13. The apparatus according to claim 12 wherein said supplementary water tank includes an air separator.

14. The apparatus according to claim 1 wherein said first water delivery means includes an air separator.

15. The apparatus according to claim 1 wherein said first water delivery means includes a supplementary water tank and an air separator.

* * * * *